US005706600A

United States Patent [19]

Toole et al.

[11] Patent Number: 5,706,600

[45] Date of Patent: Jan. 13, 1998

[54] LASER SIGHTING DEVICE FOR A WEAPON

[75] Inventors: Ronald L. Toole, Milwaukie; Lewis A. Danielson, Portland; Joseph Ouellette, Portland; Stanley F. Heard, Portland, all of Oreg.

[73] Assignee: Crimson Trace Corporation, Portland, Oreg.

[21] Appl. No.: 812,915

[22] Filed: Mar. 10, 1997

Related U.S. Application Data

[63] Continuation of Ser. No. 272,142, Jul. 8, 1994, abandoned.

[51] Int. Cl.[6] ..... F41G 1/36

[52] U.S. Cl. ..... 42/103; 362/114

[58] Field of Search ..... 42/103; 362/110, 362/113, 114

[56] References Cited

U.S. PATENT DOCUMENTS

| | | | |
|---|---|---|---|
| 1,432,254 | 10/1922 | Paterson et al. | 42/103 |
| 1,615,409 | 1/1927 | Selden et al. | 362/114 |
| 4,251,798 | 2/1981 | Swartz et al. | 235/462 |
| 4,387,297 | 6/1983 | Swartz et al. | 235/462 |
| 5,179,235 | 1/1993 | Toole | 42/103 |
| 5,304,788 | 4/1994 | Metlitsky et al. | 235/467 |
| 5,435,091 | 7/1995 | Toole et al. | 42/103 |
| 5,581,898 | 12/1996 | Thummel | 42/103 |

FOREIGN PATENT DOCUMENTS

| | | | |
|---|---|---|---|
| 116213 | 4/1946 | Sweden | 42/103 |

*Primary Examiner*—Stephen M. Johnson

*Attorney, Agent, or Firm*—William A. Birdwell & Associates

[57] ABSTRACT

A sighting device for a weapon. The device forms an integral part of the handgun and projects a laser beam onto the impact point of the intended target. The device includes a laser assembly that is preferably disposed adjacent the front of the trigger guard of the handgun. In one preferred embodiment, a laser and laser drive circuit are mounted on a flexible circuit board to accommodate movement of the laser with respect to the laser drive circuit during sight adjustments. Preferably, the laser drive circuit comprises MOSFET devices in analog mode which use comparatively low power. A switch assembly is integrally disposed in a crotch formed between the trigger guard and the handgrip. The power supply may be disposed in the bottom of the handgun's magazine which is in electrical contact with the laser sighting device.

30 Claims, 4 Drawing Sheets

LASER SIGHTING DEVICE FOR A WEAPON

This is a continuation of application Ser. No. 08/272,142, filed on Jul. 18, 1994, now abandoned.

BACKGROUND OF THE INVENTION

This invention relates to handgun sighting devices, particularly to handgun sighting devices that project a laser beam and that are adapted to form an integral part of a handgun.

In law enforcement, it is generally desirable to employ sighting devices in conjunction with handguns in order to optimize officers' targeting accuracy. Sighting devices that project laser beams are particularly desirable because, when the handgun is fired within a predetermined range, the laser beam can accurately target the impact point of the bullet by illuminating a spot on the targeted person or thing. Use of such a sighting device optimizes targeting accuracy under the adverse conditions commonly encountered when police officers are called on to fire their handguns, thereby lessening the likelihood of unintended injury to bystanders by an inaccurately fired bullet.

Prior sighting devices employing lasers have been in the nature of "add-on" structures attached to regulation handguns in an obtrusive and ungainly manner. Often, the devices hinder holstering of the handguns to which they are attached. Moreover, the devices are easily damaged or unintentionally disengaged from the handgun unless substantial care is diligently exercised. These prior sighting devices have also been difficult to adjust with respect to the targeting range. Even when properly adjusted, the adjustment can be readily lost as a result of daily, often rigorous, police activities. The mounting of prior sighting devices has often been limited to handguns having either metal frames or polymer frames, but not both.

The present application is an improvement to U.S. Pat. No. 5,179,235 (the "Toole '235 Patent"), issued Jan. 12, 1993 and incorporated by reference herein. The pistol sighting device disclosed in the Toole '235 Patent overcomes the disadvantages of prior sighting devices to a large extent by providing a sighting device which is substantially integral with a pistol or similar weapon so as to avoid obtrusive parts and which is easily and accurately adjustable. The sighting device has a laser device that is integrally positioned on the forward, substantially vertical portion of the pistol's trigger guard, mounted thereon using a pivotal positioning means. The sighting device's drive circuitry and power supply may be located within the rearward side of the pistol's handgrip behind the magazine well thereof, in a compartment in substantially parallel relation to the magazine well. The drive circuitry and power supply are connected to the sighting device's laser device by cables that extend through passages provided in the handgrip and the trigger guard of the pistol.

While the sighting device of the Toole '235 Patent provides advantageous features, it is limited in that its integration into a handgun requires substantial milling and drilling to accommodate cables for both the drive circuitry and the power supply. Thence, a need exists to provide laser sighting devices that can be integrated onto a weapon with a minimum amount of time, labor and material. To a significant extent this need has not been met because prior sighting devices employ conventional inflexible circuit boards. Conventional circuit boards are not suitable for direct mounting to the laser device because the movement of the laser device that occurs during sight adjustment cannot be accommodated by an inflexible circuit board. However, directly mounting the laser to the circuit board would, among other things, simplify the assembly and maintenance of a laser sighting device and eliminate the need for extra conductor cables and passages.

The prior sighting devices also employ conventional drive devices that consume relatively high amounts of power. In field use, high power draw may prematurely drain a laser sighting device's battery, thereby compromising a law enforcement officer's ability to use the laser sighting device to precisely sight a target. In view of battery life limitations created by the relatively high power draw of conventional laser sighting devices, there is a strong need for drive circuitry that operates with low power consumption.

In addition to the foregoing problems in prior sighting devices, the location of switching mechanisms in prior sighting devices is less than optimal. In one respect, a switching mechanism must be ergonomically located for quick and easy activation. In another respect, a switching mechanism must be located so as to minimize the risk of accidental damage that may occur during the rigors of field use which render the laser sighting device inoperable. Prior sighting devices may satisfy one respect or the other but not both. Switching mechanisms are therefore needed that would satisfy the need of law enforcement officers who, in protecting their own life or lives of others, must rely on a weapon that can be precisely and reliably employed in the split-second that an officer may have to react to a life threatening situation.

Yet another problem with existing sighting devices is that they do not provide adequate locations for housing power supplies for the laser. The conventional location for housing the power supply is within the grip of the handgun. However, in many existing handgun models there is inadequate space in the grip to accommodate a power supply unless extensive modifications are made within the grip area. For these handgun models, there is a strong need for laser sighting devices that provide for housing the power supply in the grip area, without extensive modifications within the grip area. Moreover, even for those handgun models where there is adequate space in the grip to accommodate the power supply, existing sighting devices tend to provide inadequately for the changing or recharging of the power supply. Accordingly, there is also a strong need for laser sighting devices that provide for easily changing and recharging the power supply.

Thence, because of all the foregoing inherent limitations in prior laser sighting devices, there is great demand for an improved handgun sighting device.

SUMMARY OF THE INVENTION

The present invention fulfills the aforementioned needs by providing a novel and improved sighting device for a weapon, particularly a handgun. The device forms an integral part of the handgun and projects a laser beam onto the impact point of the intended target. The laser sighting device includes a laser assembly that is preferably disposed adjacent the front of the handgun's trigger guard. In one preferred embodiment, the laser assembly has a laser in physical and electrical contact with a flexible circuit board that contains a laser drive circuit, the flexible circuit board maintaining electrical contact with, and accommodating movement of, the laser during sight adjustments. Preferably, the laser drive circuit comprises MOSFET devices in linear mode which use comparatively low power. The sighting device should further employ a switch mechanism for selectively enabling the laser device. Preferably the switch mechanism is integrally located in a crotch formed between a handgun's trigger guard and handgrip. A switch mechanism so located is readily accessible to, and operable by, the user when the user grasps and aims the handgun, even in situations where split-second reactions are required. It is also in an area where risk of accidental damage is minimal, helping to ensure that the laser can be activated when needed.

The present invention also provides a power supply housed in the magazine of a handgun. In so doing the present invention provides for a grip area located power supply that does not require any modification to the grip area of a handgun. It also provides a power supply that can be conveniently and easily accessed, changed and recharged.

Accordingly, it is a principal object of the present invention to provide a novel and improved laser sighting device for a weapon, particularly a revolver, handgun or similar weapon.

It is another object of the present invention to provide a low profile laser sighting device which forms a substantially integral part of a weapon.

It is a further object of the present invention to provide a laser sighting device that enables quick and accurate targeting of the weapon, particularly in the adverse conditions commonly encountered by police.

It is still another object of the present invention to provide a laser sighting device that has low power consumption to sustain battery life and minimize maintenance and expense.

It is yet another object of the present invention to provide a laser sighting device that is unobtrusive so as not to impede operation of the weapon.

It is another object of the present invention to provide a laser sighting device that is easily and accurately adjustable, while being resistant to disturbance in adjustment.

It is yet another object of the present invention to provide a laser sighting device that can be easily and inexpensively retrofitted onto weapons.

It is yet a further object of the present invention to provide a laser sighting device that can be used with all handguns, including those having metal or polymer frames.

It is another object of the present invention to provide a laser sighting device that does not hinder insertion of a handgun in a holster, particularly a standard issue police holster.

It is still another object of the present invention to provide a laser sighting device that provides for housing its power supply in the grip area of those handguns that have inadequate space to accommodate the power supply, without extensive modification of the grip area.

It is yet a further object of the present invention to provide a laser sighting device that provides for housing its power supply so as to be easily and conveniently changed or recharged.

The foregoing and other objects, features, and advantages of the invention will be more readily understood upon consideration of the following detailed description of the invention, taken in conjunction with the accompanying drawings.

DESCRIPTION OF THE PREFERRED EMBODIMENT

The sighting device of the present invention is adapted to be mounted onto a weapon. As used herein, "weapon" generally means any device that discharges a projectile toward a target. The laser sighting device may be positioned any place on a weapon where the beam emitted from the sighting device's laser substantially intersects with the trajectory of a projectile fired from the weapon and where the sighting device's position does not interfere with the operation or action of the weapon.

Figure 1:
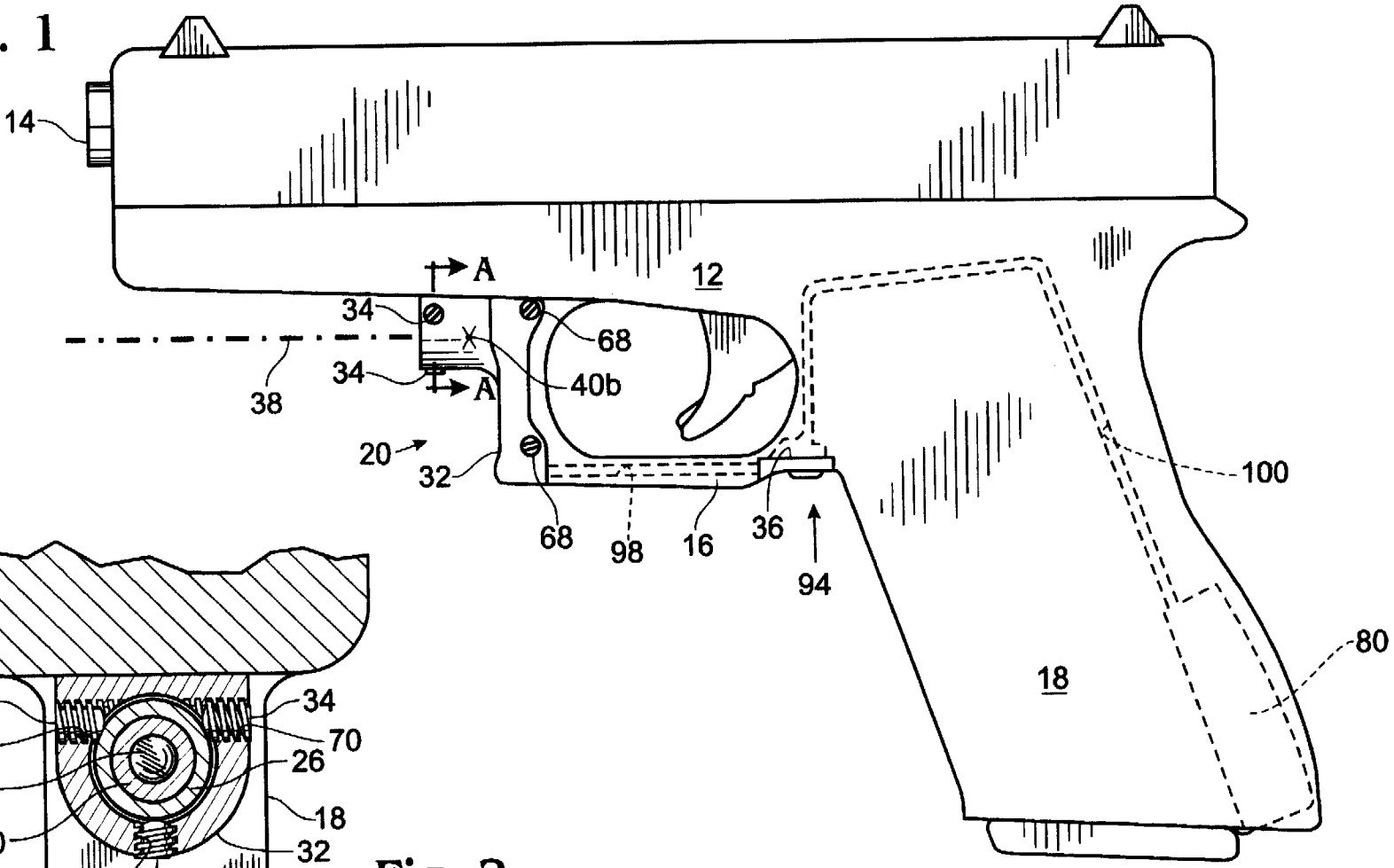
FIG. 1 is a side elevation of a preferred embodiment of a laser sighting device according to the present invention, installed on a pistol.
Figure 2:
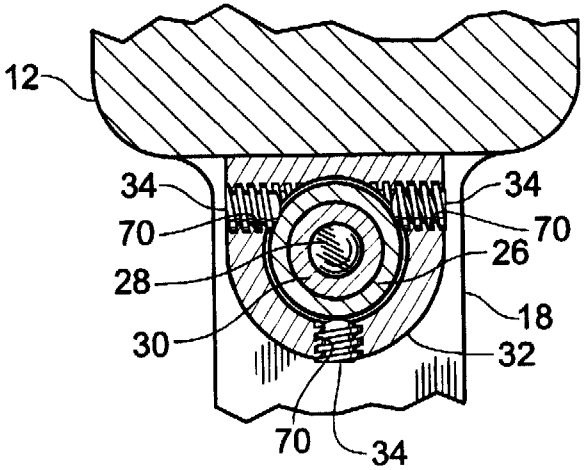
FIG. 2 is a partially cut away section taken along line A—A of FIG. 1.

Referring to FIG. 1, a sighting device is illustrated according to the principles of the present invention. The preferred weapon on which the sighting device may be mounted is a handgun 10 having a frame 12, barrel 14, trigger guard 16 and grip 18. A preferred location for mounting the sighting device is at the front of trigger guard 16. This location is preferred, among other reasons, for its unobtrusiveness. Other locations for mounting a laser sighting device on a handgun are also contemplated by this invention and will be readily apparent to persons of ordinary skill in the art.

Figures 3, 4:
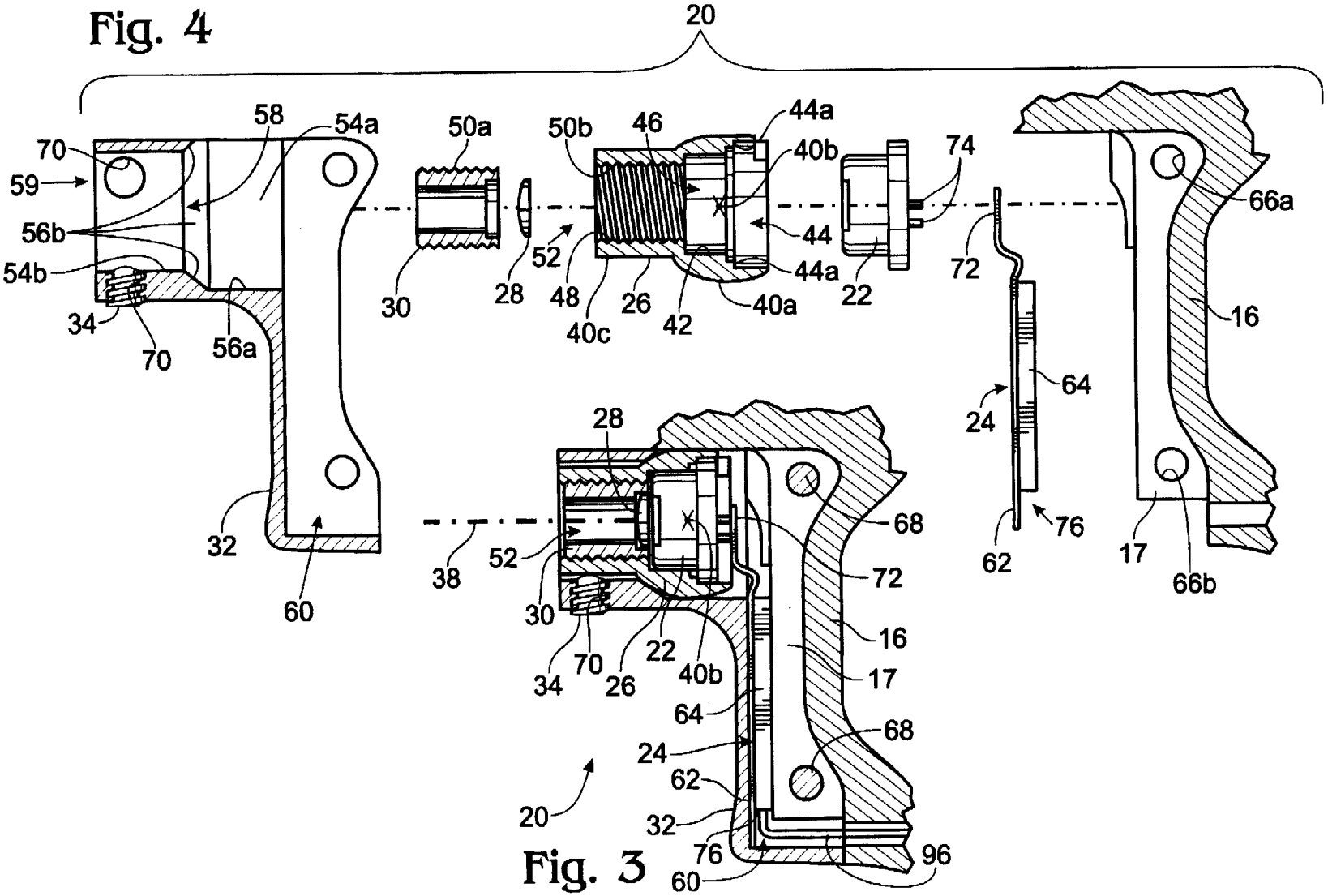
FIG. 3 is a side section of a laser assembly of the laser sighting device of FIG. 1, installed on the pistol of FIG. 1, partially cut away.
FIG. 4 is an exploded view of the laser assembly of FIG. 3.

Referring to FIG. 3 and 4, as well as FIG. 1, the sighting device includes a laser assembly 20 comprising a laser 22, laser drive circuitry 24, pivotal laser holder 26, a lens 28, a lensholder 30. The laser assembly also includes housing 32 adapted to receive pivotal laser holder 26, containing the aforementioned laser assembly elements, and adapted to be mounted on a weapon. Laser assembly 20 of the present invention allows laser 22 to be pivotally adjusted when mounted on a weapon to direct the trajectory of laser beam 38 emitted from laser 22 as desired. In this regard, one or more adjustment mechanisms 34 are provided in housing 32 to pivotally move laser holder 26 horizontally or vertically about a pivot point. The laser sighting device also includes activation switch 36, to selectively activate laser 22, and power supply 78.

Pivotal laser holder 26 is an elongate, hollow, open-ended element that provides a means for holding laser 22 and lens holder 30, which contains lens 28. It also includes a spherical or spheroid (hereinafter both terms are collectively referred to as "spherical") proximal region **40*a* which is suited for pivoting at pivot point 40*b* within housing 32 in making sight adjustments. The hollow portion of laser holder 26 comprises a first cavity 42 with a proximal opening 44 and a distal opening 46. Cavity 42 has a predetermined size and shape for fixedly receiving and seating laser 22. The diameter of distal opening 46 is such that it allows laser 22 to emit a laser beam beyond the opening. Laser 22 may be seated against distal boundary 44***a* of opening 44.

Beyond opening 46 is distal cavity 48 which has a predetermined size and shape to receive and seat lens holder 30 containing lens 28. To seat lens holder 30 in cavity 48, complementary threading 50*a* and 50*b*, respectively, may be provided on lens holder 30 and the wall of cavity 48. Techniques for seating lenses within a lens holder are well known and include adhesive bonding. Cavity 48 has opening 52 at its distal end that allow laser beam 38 to pass therefrom. By adjusting the relative position of lens 28 closer to or farther from laser 22, the lens adjusts the laser beam for size and quality.

Housing 32 includes an open ended, horizontally elongate, hollow portion adapted to pivotally receive and contain laser holder 26 and the laser assembly components contained therein. Housing 32 has a proximal cavity 54*a* for receiving and pivotally holding the spherical proximal region 40*a* of laser holder 26. Cavity 54*a* has camming or pivoting surfaces 56*a* and 56*b* at its distal end for accepting the spherical region 40*a* of holder 26. The distal end of spherical region 40*a* seats and pivots against surfaces 56*a* and 56*b*. Opening 58 in camming surface 56*b* allows distal region 40*c* of holder 26 to be received within distal cavity 54*b* of housing 32.

Distal cavity 54*b* preferably has substantially the same shape and length as distal region 40*c*, but should be comparatively larger to permit the range of horizontal and vertical movement of distal region 40*c* typically needed for sight adjustments. The horizontal or vertical movement of distal region 40*c* results in opposite pivotal movement of spherical region 40*a* against surface 56*a* and 56*b*.

Housing 32 has opening 59 at the distal end of cavity 54*b* so that the distal end of laser holder 26 may emit laser beam 38 beyond housing 32. The distal end of laser holder 26 may sit flush with or extend beyond opening 59. If it does neither, it should not be contained so far within housing 32 that the range of movement regularly needed in making adjustments to laser beam trajectory cannot be attained without laser beam 38 intersecting with the interior of cavity 54*b* so that sighting cannot be accomplished.

Preferably, housing 32 also includes elongate vertical portion 60 adapted for mounting on the front of trigger guard 16. Vertical portion 60 is recessed or otherwise adapted to receive drive circuitry 24. Drive circuitry 24 comprises an elongate flexible circuit board 62 containing laser drive circuits 64. Flexible circuit board 62 should maintain physical and electrical contact with electrical leads 74 extending rearwardly from laser 12 through the full range of sight adjustment movements of laser holder 26. Alternatively, circuit board 62 may be a conventional circuit board located separately from where the laser assembly is mounted. See, for example, the Toole '235 patent, which shows laser drive circuitry contained in a handgun's handgrip.

When housing 32 is mounted on trigger guard 16, the laser assembly components and circuit board 60 contained therein are seated between housing 32 and against the substantially vertical member 17 of trigger guard 16. Two or more complementary apertures 66*a* and 66*b* may be provided in housing 32 and trigger guard 16 for receiving securing mechanisms 68 to secure the housing to the trigger guard. In the embodiment shown in FIG. 1 through 4, housing 32 slips over trigger guard 16 so that apertures 66*a* and 66*b* are in substantial alignment. Securing mechanisms 68, which may be screws or metal dowels, are fixedly inserted through apertures 66*a* and 66*b* to secure the housing in place. A trigger guard may be milled to a configuration shown for trigger guard 16 to optimize better the integration of housing 32 to trigger guard 16.

Once laser assembly 20 is mounted on a weapon, the trajectory of laser beam 38 may be adjusted by one or more adjustment mechanisms 34 that communicate with housing 32 and pivotal laser holder 26. Adjustment mechanism 34 preferably is a threaded element adapted to be inserted into housing 32. A complementary threaded aperture 70 is provided in housing 32 so that threaded element 34 may be extended into or retracted from cavity 54*b* to adjust the longitudinal axis of distal region 40*c* horizontally or vertically relative to the trajectory of a bullet fired from barrel 14. Such vertical and horizontal adjustments may be effectuated by positioning two or more adjustment mechanisms at a suitable angle from each other relative to the longitudinal axis of pivotal laser holder 26. Preferably, adjustment mechanisms 34 also have rounded tips to maintain contact with pivotal laser holder 26 through a full range of adjustments.

Referring particularly to FIG. 3, when laser holder 26 pivots, laser 22 moves in an arc relative to contact area 72 of flexible circuit board 62. By flexing to accommodate such movements, flexible circuit board 62 maintains electrical contact with laser electrical leads 74 through the range of possible adjustments.

Figures 7, 9:
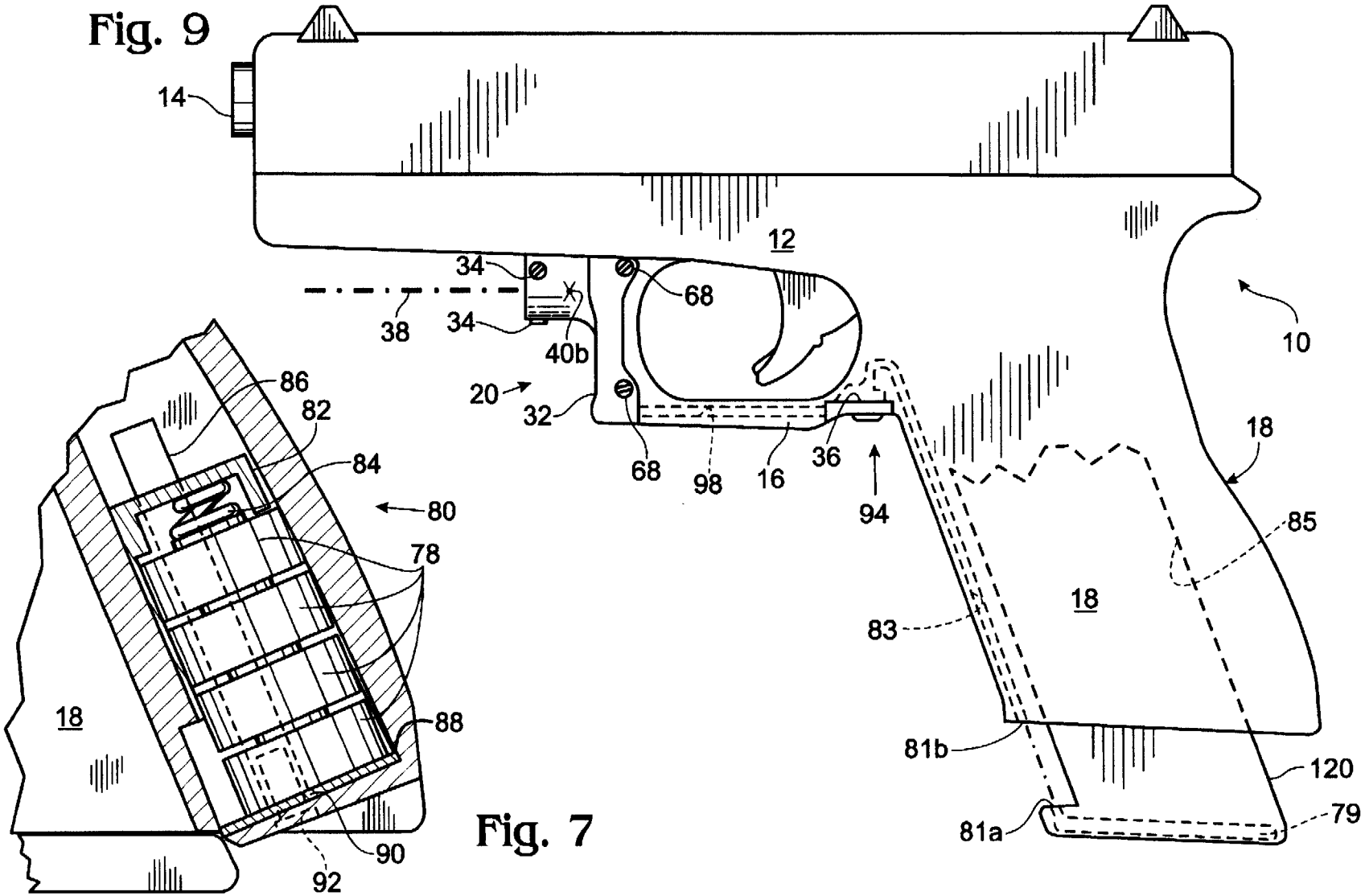
FIG. 7 is a side, partially cut away, partial section of a grip of the pistol of FIG. 1, showing batteries therein.
FIG. 9 is a side elevation of another preferred embodiment of a laser sighting device according to the present invention, installed on a pistol having a magazine well for insertion of a magazine, showing the magazine partially removed from the magazine well.

A second contact area 76 on circuit board 62 serves to connect laser drive circuitry 24 to a switching mechanism and power supply via electrical conductors 96. A preferred power supply is a battery 78 positioned in, for example, the grip area of a gun. An example of such a power supply and components thereto are described in the Toole '235 patent. In FIG. 7, a power supply assembly 80 comprises battery 78, battery holder 82, spring 84, insert brass 86, rubber gasket 88, battery cover 90 and retention screw 92. The present invention is not, however, limited to this particular embodiment of a power supply. For example, another power supply assembly 79, seen in FIG. 9, is housed in magazine 120 of a handgun so as to reduce or eliminate the extent of modification to the grip area or magazine well 85 of the handgun to accommodate the housing of a power supply assembly. Magazine 120 has disposed thereon connector 81*a* in electrical contact with the power supply assembly 79. Connector 81*a*, as shown, is located at the lower cap of magazine 120. When magazine 120 is inserted into magazine well 85, connector 81*a* engageably connects complementary connector 81*b* disposed on or in a complementary portion of the handgrip or magazine well. When connectors 81*a* and 81*b* are so connected, a power circuit from the power supply assembly 79 to switch 36 is complete. In order to complete this circuit a passage 83 is provided in grip 18 to route conductors between power supply assembly 79 and the switch 36. It will be readily apparent to persons of ordinary skill that the complementary contact points 81*a* and 81*b* may be disposed at other points on the magazine 120, and on or in the grip or magazine well, without departing from the principles of the present invention. For example, one or more contact points may be so disposed on the magazine that it will allow not only for completing a power circuit from the power supply assembly and the switch, but also for easy and convenient placement of the magazine in a battery recharger.

Figure 5:
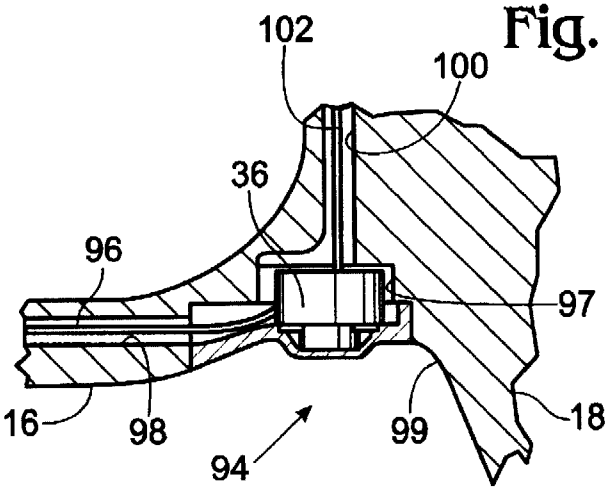
FIG. 5 is a side partial section of a switch assembly of the laser sighting device of FIG. 1, installed on the pistol of FIG. 1, partially cut away.
Figure 6:
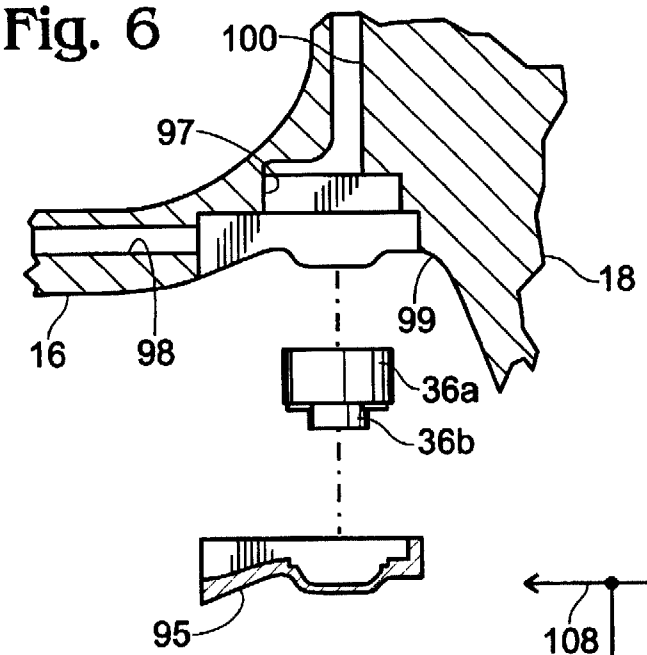
FIG. 6 is an exploded view of the switch assembly of FIG. 5.

Switch 36 is provided to activate the laser selectively. Turning to FIGS. 5 and 6, a preferred location for switch 36 is crotch 94 formed between trigger guard 16 and grip 18 of handgun 10. The switch should be activateable by gripping the gun and tensioning hand and finger muscles below the switch. To that end, a cavity 97 is formed in the crotch 94, and the crotch itself is provided with a concavity 99 for receiving the muscles of a finger positioned beneath the trigger guard 16. Accordingly, positioning switch 36 in crotch 94 essentially eliminates the need for the gun's user to engage in any manipulations other than what are already required in gripping and triggering the gun. It also provides a protected location for the switch to prevent accidental damage to it. Preferably, the switch 36 comprises a pushbutton switch having a switch body **36*a* and a pushbutton 36*b*, though other types of switching mechanisms such as a mechanical pressure switch, a heat sensitive switch, a reed switch or an electrical contact switch may be used. A cover 95 made of a polymer material such as rubber, plastic, nylon or other suitable material, may be placed over switch 36** to improve its feel and comfort and to protect the switch from damaging elements.

To make required electrical connections, electrical conductors 96 connecting switch mechanism 36, laser drive circuitry 24 and batteries 78 may be routed internally or externally in the gun. Internal routing is preferred. FIG. 1 and 9 show preferred arrangements of circuitry, switch and battery connections and routing. FIGS. 5, 6 and 7 show the routing in greater detail. Conductor passage 98 in the trigger guard and conductor passage 100 in the frame of handgun 10 are provided to connect switch mechanism 36 to batteries 78 located in grip 18 and to the laser drive circuitry 24. A conductor 102 is disposed in passage 100, between the batteries 78 and the switch 36. Preferably, the batteries 78, switch 36 and drive circuit 64 are wired in series so as to minimize the number of conductors required and the size required for passages 98 and 100. Pre-existing firearms may be milled to provide such passages. After the milling is completed, electrical conductors 96 may be inserted into passages 98 and 100 to make the appropriate connections.

In the case of an original weapon product, it may be desirable to cast the frame 12 to provide for the laser assembly 20 at the front of the trigger guard, the switch cavity 97 and concavity 99, and the passages 98 and 100. However, where an existing weapon is being retrofitted with the laser sighting device, the front of the trigger guard, the cavity 97 and the concavity 99, like the passages 98 and 100, preferably are milled to provide the features described herein.

Figure 8:
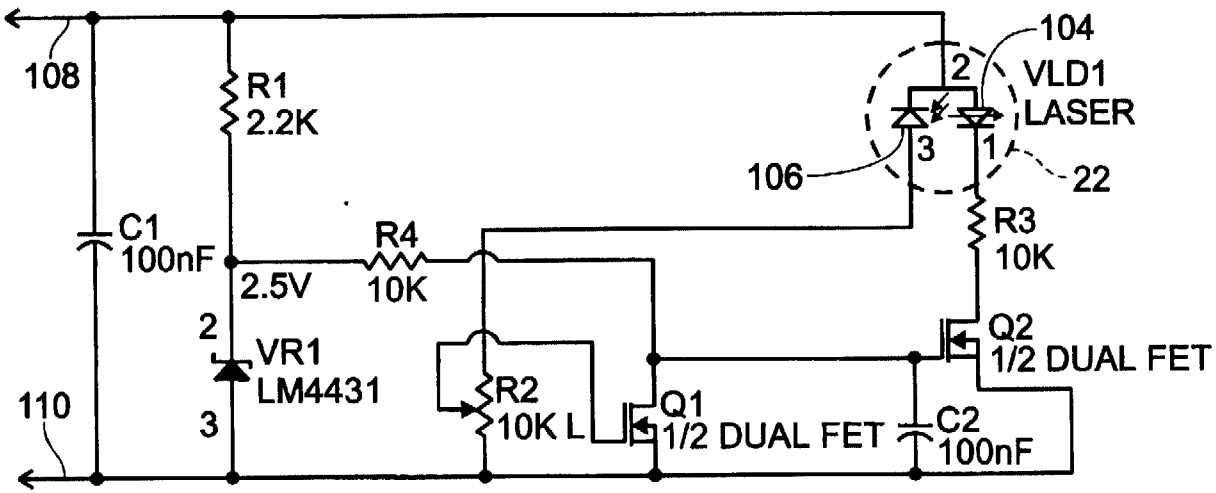
FIG. 8 is a schematic diagram of a preferred embodiment of a device circuit for a laser sighting device according to the present invention.

Turning to FIG. 8, the laser and laser drive circuit compromise laser 22, which includes a laser diode 104 and photodiode 106 optically coupled to the laser drive circuit, and a voltage regulation circuit. The drive circuit employs metal-oxide silicon field effect transistor (MOSFET) devices Q1 and Q2 biased by resistors R2 and R4 to operate as analog amplifiers. Q2 drives the laser diode 104, while Q1 provides negative, closed loop feedback control in response to photodiode 106, to prevent overdriving laser diode 22. R3 provides the appropriate, laser diode current bias. R2 is used to adjust the intensity of the laser. R4 is the load resistor for Q1. C2 controls the response time of the feedback loop.

Q1 and Q2 require relatively low voltage and low current because they are MOSFET devices. More specifically, the drive circuit can be operated on 2.5 volts. This voltage is provided by voltage regulator VR1 and Resistor R1. Capacitor C1 helps to regulate the voltage from the batteries, which are connected through switch 36 to the drive circuit by conductors 108 and 110.

The terms and expressions which have been employed in the foregoing specification are used therein as terms of description and not of limitation, and there is no intention in the use of such terms and expressions of excluding equivalents of the features shown and described or portions thereof, it being recognized that the scope of the invention is defined and limited only by the claims which follow.

We claim:

1. In a weapon, a laser sighting device, comprising:

a laser;

a laser drive circuit; and a flexible circuit having a laser connection portion on which said laser is mounted and a drive circuit portion on which said laser drive circuit is mounted, said drive circuit portion being substantially seated in the weapon, said laser connection portion electrically connecting said laser to said drive circuit throughout a range of movement of said laser by flexing so as to permit repeated adjustment of the beam direction of said laser.

2. The device of claim 1, further comprising a housing, said laser and said laser drive circuit being disposed within said housing and said housing being adapted to mount on a weapon.

3. The device of claim 2, wherein said housing includes a forwardly protruding portion having a cavity for receiving said laser.

4. The device of claim 3, wherein said forwardly protruding portion includes means for adjusting the beam direction of said laser.

5. The device of claim 3, further comprising a laser holder disposed within said forwardly protruded portion of said housing for receiving said laser, said laser holding having a pivot surface for tilting said laser holder with respect to said housing to adjust the beam direction of said laser.

6. The device of claim 5, further comprising at least one threaded member disposed in a matching threaded aperture in said housing so as to tilt said laser holder.

7. The device of claim 1, further comprising one or more adjustment mechanisms for selectively adjusting the trajectory of the laser beam.

8. The device of claim 1, further comprising a switch for activating said laser, said switch having a pushbutton.

9. The device of claim 8, further comprising a flexible cover disposed over said switch.

10. The device of claim 1, wherein the weapon includes a trigger guard, and wherein said laser is disposed at the front of the trigger guard.

11. The device of claim 1, wherein the weapon includes a grip, the device further comprising a power supply electrically connected to said drive circuit portion for supplying power to said laser drive circuit, wherein said power supply is disposed within the grip.

12. The device of claim 1, wherein the weapon includes a trigger guard and a grip joining the trigger guard at a junction therebetween, the device further comprising a switch for activing said laser drive circuit, wherein said switch is disposed proximate the junction.

13. A laser sighting device, comprising a laser, a laser drive circuit and a housing, said laser and said drive circuit being mounted on a flexible circuit board that accomodates movement of said laser with respect to said drive circuit so as to permit the beam direction of said laser to be adjusted with respect to the position of said drive circuit, said laser and said laser drive circuit being disposed within said housing and said housing being adapted to mount on a handgun having a trigger guard, said housing being adapted to be mounted on the front of said trigger guard.

14. The device of claim 13, wherein said trigger guard is disposed beneath a barrel, said housing is disposed on the front of said trigger guard beneath said barrel, and said laser and drive circuit are disposed within said housing.

15. A laser sighting device, comprising a laser and a laser drive circuit said laser and said drive circuit being mounted on a flexible circuit board that accomodates movement of said laser with respect to said drive circuit so as to permit the beam direction of said laser to be adjusted with respect to the position of said drive circuit, wherein said device is mounted on a weapon having a grip and a trigger guard with one end adjacent said grip, the device further comprising a switch for activating said laser in a crotch formed between said trigger guard and said grip.

16. The device of claim 15, wherein said switch is connected to said laser by electrical conductors disposed within the trigger guard.

17. A laser sighting device, comprising a laser and a laser drive circuit, said laser and said drive circuit being mounted on a flexible circuit board that accomodates movement of said laser with respect to said drive circuit so as to permit the beam direction of said laser to be adjusted with respect to the position of said drive circuit, wherein said drive circuit employs MOSFET amplifiers operating in analog mode.

18. A laser sighting device, comprising a laser and a laser drive circuit, said laser and said drive circuit being mounted on a flexible circuit board that accomodates movement of said laser with respect to said drive circuit so as to permit the beam direction of said laser to be adjusted with respect to the position of said drive circuit, wherein said device is mounted on a weapon, said weapon having a trigger guard, said laser and said laser drive circuit being disposed at the front of said trigger guard.

19. A laser sighting device adapted to mount on a weapon having a grip, said device further comprising a laser, a laser drive circuit, and a power supply disposed in the grip, said laser and said drive circuit being mounted on, and pivotally mounted relative to, a flexible circuit board that accomodates movement of said laser with respect to said drive circuit so as to permit the beam direction of said laser to be adjusted with respect to the position of said drive circuit.

20. The device claim 19, wherein said weapon includes a trigger guard, and said device further comprises a switch disposed adjacent the trigger guard for activating said laser drive circuit.

21. The device of claim 20, wherein said weapon includes a frame, and said device further comprises electrical conductors disposed in the frame and trigger guard of the weapon to connect electrically said power supply, said switch and said laser drive circuit.

22. A laser sighting device, comprising a laser and a laser drive circuit, said laser and said drive circuit being mounted on, an pivotally mounted relative to, a flexible circuit board that accomodates movement of said laser with respect to said drive circuit so as to permit the beam direction of said laser to be adjusted with respect to the position of said drive circuit, wherein said device is mounted on a weapon so that said laser emits a beam in substantially intersecting relation with the trajectory of a projectile fired from said weapon.

23. A laser sighting device, comprising a laser, a laser drive circuit and a housing, said laser and said drive circuit being mounted on a flexible circuit board that accomodates movement of said laser with respect to said drive circuit so as to permit the beam direction of said laser to be adjusted with respect to the position of said drive circuit, said laser and said laser drive circuit being disposed within said housing and said housing being adapted to mount on a weapon, wherein said weapon comprises a handgun having a trigger guard to receive said laser and said laser drive circuit, the front of said trigger guard being machined to receive said laser housing, and said laser housing being mounted on said trigger guard.

24. The device of claim 23, wherein said handgun includes a grip adapted to permit holding the handgun, further comprising a laser activation switch, said switch being mounted in a crotch formed by machining an area where said trigger guard and grip meet.

25. The device of claim 24, further comprising electrical conductors received in and routed through passages machined in the trigger guard and grip.

26. A laser sighting device, comprising a laser and a laser drive circuit, said laser and said drive circuit being mounted on a flexible circuit board that accomodates movement of said laser with respect to said drive circuit so as to permit the beam direction of said laser to be adjusted with respect to the position of said drive circuit, wherein said laser comprises a laser diode and a photodetector optically coupled to the output of said laser diode, and said laser drive circuit comprises a first MOSFET connected to said laser diode for controlling the current therethrough, and a second MOSFET connected to a power source, said photodetector and said first MOSFET so as to control the current through said laser diode in response to said photodetector.

27. The device of claim 26, wherein the drain of said first MOSFET is connected to said laser diode, the drain of said second MOSFET is connected to the gate of said first MOSFET and through a resistor to one pole of the power source, the gate of said second MOSFET is connected through a resistor to said photodetector, and the source of said first MOSFET and the source of said second MOSFET are connected to another pole of the power source.

28. The device of claim 27, wherein said first and second MOSFETs are selected so as to have a relatively low gate-source voltage.

29. A laser sighting device, comprising a laser and a laser drive circuit, said laser and said drive circuit being mounted on a flexible circuit board that accomodates movement of said laser with respect to said drive circuit so as to permit the beam direction of said laser to be adjusted with respect to the position of said drive circuit, wherein said device is adapted for use in a weapon, said weapon having a magazine well for receiving a magazine, and wherein said device further comprises a connector, said connector for completing an electrical circuit between said laser drive circuitry and said magazine when said magazine is received with said magazine well.

30. A laser sighting device, comprising a laser and a laser drive circuit, said laser and said drive circuit being mounted on a flexible circuit board that accomodates movement of said laser with respect to said drive circuit so as to permit the beam direction of said laser to be adjusted with respect to the position of said drive circuit, wherein said device is adapted for use in a weapon, said weapon having a magazine well for receiving a magazine, and wherein said device further comprises a power supply holder, said laser being disposed on the weapon and said power supply holder being disposed in said magazine in electrical connection with said laser when said magazine is received within said magazine well.

* * * * *